US011932945B2

(12) United States Patent
Rustici Venturini et al.

(10) Patent No.: US 11,932,945 B2
(45) Date of Patent: Mar. 19, 2024

(54) METHOD TO MANUFACTURE A COMPONENT FOR A MACHINE FOR THE PRODUCTION AND/OR PACKAGING OF PHARMACEUTICAL PRODUCTS

(71) Applicant: I.M.A. INDUSTRIA MACCHINE AUTOMATICHE S.P.A., Ozzano dell'Emilia (IT)

(72) Inventors: Gabriele Rustici Venturini, Ozzano dell'Emilia (IT); Claudio Trebbi, Ozzano dell'Emilia (IT); Gabriele Gabusi, Ozzano dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 0 days.

(21) Appl. No.: 17/426,173

(22) PCT Filed: Jan. 30, 2020

(86) PCT No.: PCT/IT2020/050012

§ 371 (c)(1),
(2) Date: Jul. 28, 2021

(87) PCT Pub. No.: WO2020/157781

PCT Pub. Date: Aug. 6, 2020

(65) Prior Publication Data

US 2022/0098716 A1 Mar. 31, 2022

(30) Foreign Application Priority Data

Jan. 30, 2019 (IT) ..... 102019000001323

(51) Int. Cl.

| | |
|---|---|
| ***C23C 4/08*** | (2016.01) |
| ***C23C 4/073*** | (2016.01) |
| ***C23C 4/129*** | (2016.01) |
| ***C23C 24/04*** | (2006.01) |

(52) U.S. Cl.
CPC ..... *C23C 4/08* (2013.01); *C23C 4/073* (2016.01); *C23C 4/129* (2016.01); *C23C 24/04* (2013.01)

(58) Field of Classification Search
CPC ..... C23C 24/04
See application file for complete search history.

(56) References Cited

FOREIGN PATENT DOCUMENTS

| | | | | |
|---|---|---|---|---|
| CN | 103422088 B | * | 3/2016 | |
| CN | 106694872 A | * | 5/2017 | ..... B22F 3/00 |
| EP | 1354978 A1 | | 10/2003 | |
| WO | 2006101467 A1 | | 9/2006 | |
| WO | WO-2006101467 A1 | * | 9/2006 | ..... A61L 2/07 |
| WO | WO-2013015651 A2 | * | 1/2013 | ..... B01D 61/00 |
| WO | 2013126134 A1 | | 8/2013 | |

OTHER PUBLICATIONS

Cold-Spray Coatings: Recent Trends and Future Perspectives, Edited by P. Cavaliere, Springer International Publishing, Switzerland, 2017 (Year: 2017).*

International Search Report for corresponding application PCT/IT2020/050012 filed Jan. 30, 2020; dated May 19, 2020.

J.Svrcek, "Degradtion of biologically active substances by vapor-phase hydrogen peroxide", Research on Chemical Intermediates, vol. 40, No. 2., Jan. 1, 2013, pp. 619-626, XP055638136.

Maresh Rohatgi, "Certification of Vapor Phase Hydrogen Peroxide Sterilization Process for Spacecraft Application", SAE Technical Paper Series, vol. 1, Jul. 15, 2002, XP055638109.

Written Opinion for corresponding application PCT/IT2020/050012 filed Jan. 30, 2020; dated May 19, 2020.

* cited by examiner

*Primary Examiner* — Tabatha L Penny
(74) *Attorney, Agent, or Firm* — CANTOR COLBURN LLP

(57) ABSTRACT

Method to manufacture a component suitable to be installed inside a protected chamber with a controlled atmosphere of a machine for the production and/or packaging of pharmaceutical products, configured to receive one or more pieces of equipment, or devices, or elements, each formed by one or more of the components, wherein the interior of the chamber, that is to say, the components that form the equipment, or the devices, or the elements, is/are intended to be subjected to suitable decontamination and sterilization treatments, for example CIP (Clean-In-Place) treatments and/or SIP (Sterilizing-In-Place) treatments; There are also described components that are manufactured with the manufacturing method as above, and a method to prepare a protected chamber, isolated from the external environment, of a machine for the production and/or packaging of pharmaceutical products.

11 Claims, 2 Drawing Sheets

METHOD TO MANUFACTURE A COMPONENT FOR A MACHINE FOR THE PRODUCTION AND/OR PACKAGING OF PHARMACEUTICAL PRODUCTS

FIELD OF THE INVENTION

The invention concerns a method to manufacture a component suitable to be used in a machine for the production and/or packaging of pharmaceutical products.

In particular, the present invention concerns a method to manufacture a component that can be subjected to decontamination and sterilization treatments (CIP/SIP) normally performed in this sector, also comprising treatment cycles using hydrogen peroxide vapors (HPVs).

The present invention also concerns a method to prepare a protected chamber for a machine for the production and/or packaging of pharmaceutical products in which it is provided to carry out the decontamination and sterilization treatments as above.

BACKGROUND OF THE INVENTION

In the pharmaceutical sector, the processing and packaging operations of pharmaceutical products such as, for example, powders, tablets, pills, liquids, or suchlike, are carried out inside a chamber that is protected and separated from the external environment, generally called "isolator", which is maintained in conditions of sterility and in a controlled atmosphere.

Manipulation, working and/or packaging devices and equipment are generally disposed inside the protected chambers, suitable to carry out respective specific operations on the pharmaceutical products instead of human operators.

The protected chambers, together with the equipment and devices positioned inside them, have to meet determinate cleanliness and sterility requirements. The chambers, therefore, are generally subjected to intensive treatments to keep them in the required sterility conditions and eliminate possible contaminating substances. For example, it is known to subject these chambers to treatments that use hydrogen peroxide vapor, which, however, while having a highly effective bactericidal, sporicidal and fungicidal action, has a high oxidizing power that can damage the surfaces of the equipment present in these chambers.

To try to solve this problem it is known to manufacture components for the equipment and devices having a base body made with a light material that acts as a substrate, which is coated with a material for coating and protecting the substrate.

For example, components made of aluminum are known, coated with a layer of paint, or subjected to treatments for anodizing the aluminum, or provided with galvanic coatings, in particular based on Chrome (Cr), Nickel (Ni), or other suitable metals.

Solutions are also known which provide to coate the components by means of immersion in a bath of metal or plastic material, or resin. One disadvantage of these solutions, however, is that in this way the coating is applied both on the external surface and also on the internal surface of the components, that is, also on the part that, during use, is not exposed to the sterilization/sanitization treatments, and therefore large quantities of coating material are required.

One purpose of the present invention is to perfect a method to manufacture a component that can be used in isolators, or in protected chambers in the pharmaceutical sector, which overcomes at least some of the disadvantages of the state of the art.

In particular, one purpose is to perfect a method to manufacture a component that is light and at the same time suitable to resist intensive decontamination treatments.

Another purpose is to perfect a method to prepare a protected chamber for a machine for the production and/or packaging of pharmaceutical products, without needing to preemptively disassemble and/or remove the equipment inside it, thus being able on the one hand to reduce the time necessary for the treatment, reducing machine downtimes, and on the other to guarantee an effective decontamination of all the surfaces which, during use, are located in contact with the products to be processed.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

Embodiments described here concern a method to manufacture a component suitable to be subjected to decontamination and sterilization treatments in a chamber, also called "isolator", of a machine for the production and/or packaging of pharmaceutical products, which is isolated from the external environment and is maintained in a controlled atmosphere.

In one embodiment, the decontamination and sterilization treatments as above comprise, for example, CIP (Clean-In-Place)/SIP (Sterilizing-In-Place) treatments, which provide to use hydrogen peroxide vapors (VPHP, Vapor Phase Hydrogen Peroxide).

With the term "component", here and in the following description we mean an object that can be used on its own, or in connection with other components or objects or parts of the machine, to create a device or a piece of equipment.

By way of a non-limiting example, the term "component" may indicate a fixed column, a drive shaft, a transport wheel for belts, a container, a cover, or a casing for gearboxes and/or motors, an articulated component of a robot or a part thereof, a support element, such as for example a bracket, a flange, a fixed or mobile arm, a slider, a drum, a pulley, or also an attachment member such as a screw, bolt, and similar or comparable elements.

The method according to the invention provides to make available a component made of a first material chosen from a group comprising aluminum (Al), magnesium (Mg), titanium (Ti), steel, or their alloys, composite materials with a polymer matrix, carbon fibers, or combinations thereof, wherein the component is intended to be installed inside the chamber, and is provided to this end with coupling portions configured to be coupled with corresponding and mating coupling portions provided on other components, or with internal walls of the chamber, and comprises at least one external surface which, in an assembled and installed condition of the component, faces toward the outside, that is, being directly exposed to the atmosphere of the chamber.

The method also provides, before assembling or installing the component in the chamber, that is, before its coupling portion is stably joined to the corresponding mating coupling portion, or to internal walls of the chamber, to subject the component to a thermal spray treatment using solid powders of a second material, accelerated in a supersonic gaseous jet, wherein the second material is chosen from a group comprising one or more of either stainless steel, a cobalt-chromium metal alloy, such as for example stellite, a nickel alloy, a material with a polymer matrix, such as for example polyetheretherketone (PEEK), a metal-ceramic composite material, carbon fibers, or other, in order to deposit a coating of the second material at least on the external surface of the component to make it suitable to withstand either the decontamination or the sterilization treatments as above.

In this way, the component, being coated externally with a corrosion-resistant material, has surface properties suitable to resist CIP (Clean in Place) and/or SIP (Sterilize in Place) treatments, in particular in the field of production and packaging of pharmaceutical products. The component manufactured with the method according to the invention, in particular, can also be subjected to treatments which provide to use hydrogen peroxide in the form of vapor VPHP (Vapor Phase Hydrogen Peroxide) as a sterilizing agent, which is particularly aggressive and tends to oxidize the surfaces with which it comes into contact.

According to some embodiments, the coupling portions can comprise coupling edges configured to be facing, and coupled with, corresponding coupling edges of another component, in order to produce a part of a device or of a piece of equipment, or possibly to be facing and coupled with an internal wall of the chamber.

According to some embodiments, the coupling edges are configured to create, with a corresponding coupling edge, a reciprocal coupling of the two components in a condition of isolation with respect to the external environment.

With the expression "create a reciprocal coupling in a condition of isolation", in the present description we mean the reciprocal coupling of two components such that possible internal surfaces of the individual components, during use, remain separated and isolated from the external environment, but that possible internal compartments of components connected to and coupled with each other are operationally connected with each other, but in any case isolated with respect to the outside.

According to some embodiments, the thermal spray treatment is a cold spray treatment in which solid powders of the second material are accelerated in a supersonic gaseous jet, and are made to violently impact the surfaces to be coated.

According to other embodiments, the thermal spray treatment is a high velocity oxygen-fuel (also known as HVOF) coating spray treatment, in which particles of the second material, in a melted or partly melted form, are mixed with a flow of supersonic gas at high temperature and high speed and sprayed onto the surface to be coated.

Compared to other thermal spray treatments, in the cold spray treatment and in the high velocity oxygen-fuel (HVOF) coating spray treatment most of the energy supplied to the particles is of the kinetic rather than thermal type, so it is advantageously possible to obtain a reduction of particles that oxidize during processing, allowing to obtain a highly resistant final coating.

According to some embodiments, the method provides to spray on the external surface a mixture of a gas and solid particles of the second material with a speed comprised between 300 m/s and 1400 m/s, and to hold the component on each occasion in a fixed and stable position, by means of supports suitable to resist the force exerted by the mixture of gas and particles.

According to embodiments described here, the method in particular provides to separately subject a single component to the thermal spray treatment, and to deposit the coating at least on the respective external surfaces and on the respective coupling edges.

According to some embodiments, for the cold spray treatment, the method provides to use a spray nozzle mounted on an articulated arm or a numerical control machine having at least four working axes, and to follow with it the development of the surface to be treated. In this way, it is possible to follow the development of the external surface and of the coupling edges of the single components precisely, and to direct, on each occasion, the spray nozzle in a suitable manner with respect to the surface to be treated.

According to some embodiments, the method provides to spray the material onto the surface to be treated with an angle of incidence comprised between ±45° with respect to the perpendicular of the external surface and/or of the coupling edges. The angle of incidence can vary as a function of the radius of curvature of the surface to be treated, or as a function of possible uneven parts or corners present therein, so as to direct the mixture of gas and particles of the second material in a targeted manner, and obtain a substantially uniform coating.

According to some embodiments, the method provides to deposit a layer of material with a thickness comprised between about 15 μm and about 100 μm with each spraying action.

Embodiments described here concern a component suitable to be subjected to CIP/SIP treatments in a protected chamber of a machine for the production and/or packaging of pharmaceutical products, comprising coupling portions configured to be coupled with corresponding and mating coupling portions provided on other components or to walls of the chamber, wherein the component is made of a first material chosen from a group comprising aluminum (Al), magnesium (Mg), titanium (Ti), steel, or their alloys, composite materials with a polymer matrix, carbon fibers, also comprising at least one external surface which, in an assembled and installed condition of the component, faces toward the outside, that is, it is directly exposed to the atmosphere of the chamber where it is subjected to decontamination or sterilization treatments, such as for example CIP (Clean-In-Place) treatments and/or SIP (Sterilizing-In-Place) treatments which provide to use hydrogen peroxide vapors (VPHP, Vapor Phase Hydrogen Peroxide), and is provided with a coating made of a second material, chosen from a group comprising one or more of either stainless steel, cobalt-chromium metal alloy, nickel alloy, material with a polymer matrix, metal-ceramic composite material, wherein the coating of the second material is obtained by thermal spraying using powders accelerated in a supersonic gaseous jet.

The present invention also concerns a method to prepare a chamber of a machine for the production and/or packaging of pharmaceutical products, wherein the chamber is a protected chamber, with a controlled atmosphere, isolated and separated from the external environment in a sealed manner, and configured to receive one or more pieces of equipment, or devices, or elements.

The method according to the invention provides to:

make a plurality of components using the manufacturing method according to the present invention;

assemble or install the components in the respective positions inside the chamber in correspondence with respective coupling portions configured to be coupled with corresponding and mating coupling portions provided on another component or on an internal wall of the chamber, in order to make at least one piece of equipment, or at least one device, or at least one element, to work the pharmaceutical products;

dispose the piece(s) of equipment, and/or the device(s), and/or the element(s), and/or other components in the chamber;

close the chamber in such a way as to isolate it in a sealed manner from the external environment;

subject the interior of the chamber, that is, the pieces of equipment, the devices, the elements, and the possible other components that have been previously disposed therein, to a decontamination or sterilization treatment, for example a CIP (Clean-In-Place)/SIP (Sterilizing-In-Place) treatment so as to decontaminate and/or sterilize at least the respective external surfaces of the components and/or of the pieces of equipment, and/or of the devices and/or of the elements.

Since all the surfaces that are exposed to the decontamination/sterilization treatment inside the chamber have been previously subjected to the coating treatment, the external surfaces of the equipment, of the devices and of the elements are not ruined or damaged by the decontaminants used. The decontamination treatments can therefore be repeated, when necessary, without needing to remove or cover the components and equipment inside the machine, thus allowing significant savings of time and manpower required.

According to some embodiments, the step of subjecting the chamber and the components, devices and/or equipment disposed therein to a CIP/SIP treatment provides to carry out treatments in which it is provided to use hydrogen peroxide in the form of vapor (VPHP, Vapor Phase Hydrogen Peroxide) as a sterilizing agent.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Embodiments described here concern a method to manufacture a component 10 suitable for use in protected chambers 12, also called "isolators", of machines for the production and/or packaging of pharmaceutical products, which are separated from the external environment in a sealed manner, and have to meet stringent sterility requirements to prevent possible contaminations of the pharmaceutical products being processed.

Figure 1:
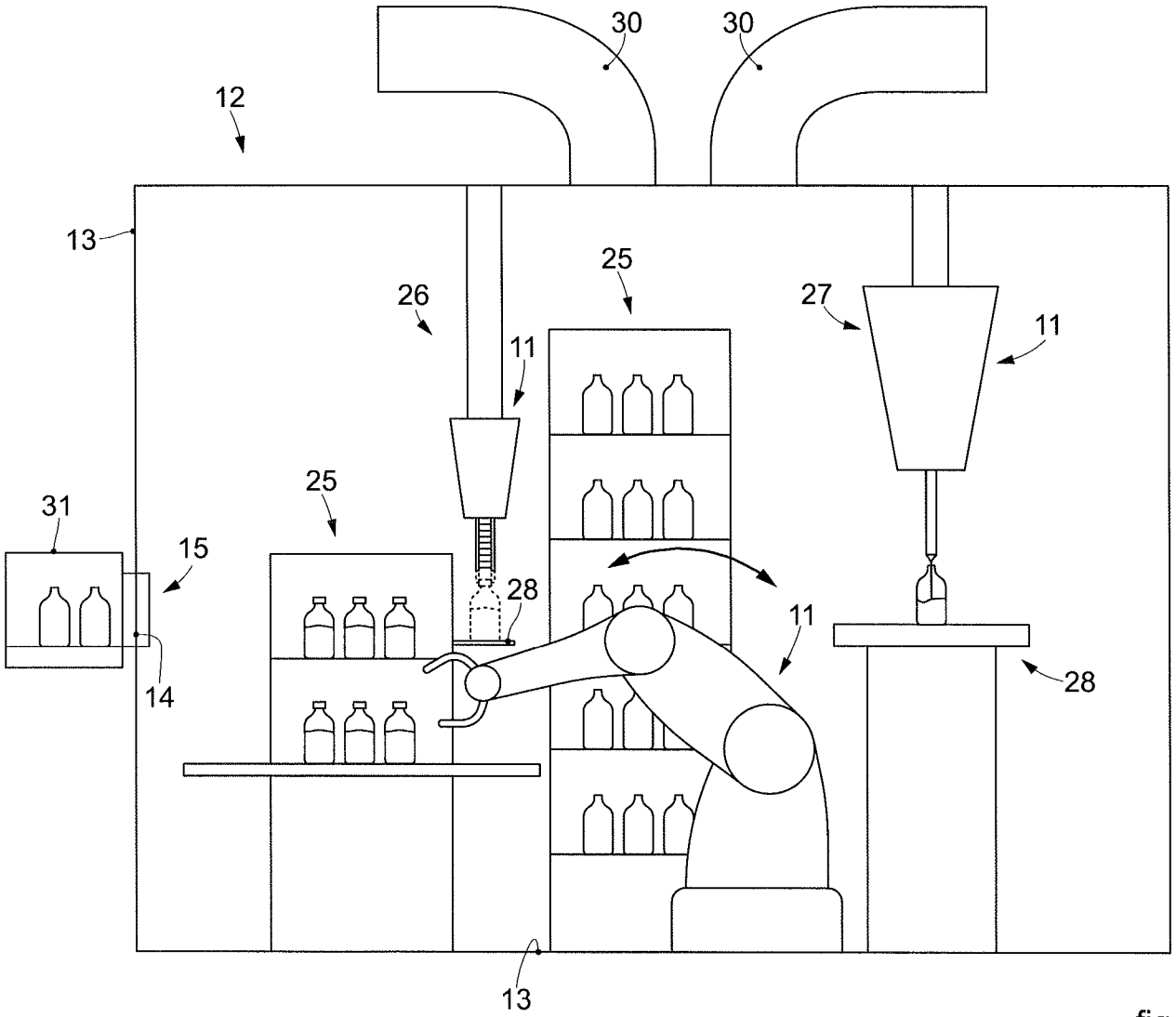
FIG. 1 is a schematic, front elevation view of a portion of a machine for the production and/or packaging of pharmaceutical products, in which a preparation method according to embodiments described here can be implemented and in which a plurality of components and pieces of equipment according to the present invention are disposed.

As can be seen in the example embodiment of FIG. 1, the chamber 12 is normally isolated and delimited from the outside by walls 13. Furthermore, the chamber 12 is generally kept in a controlled atmosphere by means of suitable conduits 30 configured to introduce and/or extract one or more suitable gases into/from the atmosphere of the chamber 12, implementing an HVAC system widely used in many industrial applications.

It should be noted that in the example shown, it is provided to manipulate ampoules, vials or small glass bottles inside the chamber 12, suitable to contain a metered quantity of a pharmaceutical product. It is evident that the method to manufacture components and the method to prepare an isolated chamber according to the present invention are independent of the particular type of objects manipulated in the isolated chamber, which can be any type of container whatsoever suitable to contain a pharmaceutical product, as well as being syringes or blisters.

On at least one of the walls 13 there is normally at least one access aperture 14 provided with a transfer port 15 which allows a protected transfer of material inside and outside the chamber 12, preventing a direct connection between the environment inside the chamber 12 and the environment outside the chamber 12 itself. The transfer port 15, which is subject to certifications attesting its compliance with current regulations, is generally known as the Alpha-Beta port or also as RTP, an acronym for Rapid Transfer Port. The transfer port 15 is suitable to allow the temporary connection of a closed container 31 to the wall 13 of the chamber 12. By way of example, the container 31 can be used to transport vials to be filled with a pharmaceutical product inside the chamber 12.

In the example embodiment of FIG. 1, inside the chamber 12 there are provided a station 26 for capping the vials, a station 27 for filling the vials, an articulated arm suitable to move the vials, and one or more storage spaces 25 for the temporary storage of the vials. The capping stations 26 and the filling stations 27 comprise respective support elements 28 on which the vial being processed can rest, and a respective suitable hopper in which the caps and the liquid to be injected inside the vial are respectively fed.

With the term "component", here and in the following description we mean an object that can be used on its own, or in connection with other components or objects or parts of the machine. By way of example, a component 10 of the type in question can be a fixed column, a drive shaft, a transport wheel for belts, a cover, or a casing for gearboxes and/or motors, an articulated component of a robot, a support element, such as for example brackets, flanges, fixed or mobile arms, sliders, drums, pulleys, attachment elements such as a screw, bolt, or similar or comparable members or elements.

According to some embodiments, the components 10 can be assembled and coupled with each other to compose a piece of equipment 11 and/or a device and/or an element suitable to perform one or more operations on the pharmaceutical products, comprising manipulation of the products, movement, transport, or packaging thereof.

By way of example, a piece of equipment 11 can comprise an automatic operator device, such as an articulated robot, or in general manipulation, movement, or other devices. In the example of FIG. 1, a plurality of pieces of equipment or devices can be seen, formed by a plurality of components, such as for example the storage space 25, the stations 26 and 27, or the articulated robot.

The components 10 and the pieces of equipment 11 in question can advantageously be subjected to suitable decontamination and sterilization treatments inside the protected chamber 12, for example CIP (Clean-In-Place) and/or SIP (Sterilizing-In-Place) treatments, which provide to use hydrogen peroxide vapors VPHP (Vapor Phase Hydrogen Peroxide), which has a high oxidizing power with bactericidal, sporicidal and fungicidal action, without oxidation of their external surface, or possible damage to the components 10 themselves, occurring.

According to some embodiments, each component 10 can be provided with at least one coupling portion suitable to be coupled with a mating coupling portion, provided on another component 10, or to an internal wall 13 of the chamber 12.

As a function of the type of component 10 in question, that is, a single element or an element which, in the installed and assembled condition, defines a part of a piece of equipment 11 (or of another device or element), the coupling portion can be configured as a coupling surface, or a coupling edge 17, or can comprise a plurality of both.

According to some embodiments, the coupling edges 17 can extend in a transverse direction with respect to the respective external surface 18, defining with it a corner 24 having a substantially stepped development.

The coupling portions can delimit an external surface 18 of the component 10 which, during use, faces toward the outside, and is therefore exposed to the atmosphere inside the chamber 12.

In other words, the coupling portions can substantially delimit on one side the external surface 18 of the component 10 which, during use, has to be subjected to the decontamination and sterilization treatments, and on the other side the internal surface 19 of the component 10, which, during use, and in an assembled and installed condition, is not located in contact with the atmosphere of the chamber 12 and therefore does not have to be subjected to the decontamination and sterilization treatments.

According to some embodiments, the manufacturing method according to the invention provides to:

make available a component 10 suitable to be installed in a chamber 12 and/or assembled with another component 10, provided with at least one coupling portion, which delimits an external surface 18 facing, during use, toward the outside (that is, exposed to the atmosphere of the chamber 12), and configured to be coupled with a corresponding coupling portion of another component or with an internal wall 13 of the chamber 12, wherein the component 10 is made of a first material;

subject the component 10 to a thermal spray treatment using solid powders of a second material accelerated in a supersonic gaseous jet, in order to deposit a coating 20 of a second material at least on the external surface 18 of said component 10 intended to be facing, during use, in an installed condition, toward the outside, exposed to the atmosphere of the chamber 12 and therefore intended to be subjected to CIP/SIP treatments.

According to some embodiments, the components 10 in question are made of a first light material, so as to facilitate the operations of installation and/or removal from the protected chamber 12 and facilitate the transport and movement thereof and of the respective pieces of equipment 11 which they make up.

According to some embodiments, the first material can be chosen from a group comprising aluminum (Al), magnesium (Mg), titanium (Ti), steel, or their alloys, composite materials with a polymer matrix, carbon fibers, or combinations thereof.

According to some embodiments, the surface finish of the components 10 has a certain minimum surface roughness which allows the particles that will be sprayed in the spraying process to deposit and remain attached to the external surface 18.

Preferably, the minimum surface roughness Ra of the external surface 18 of the components 10 is comprised between about 1.6 and about 12.5 μm.

According to some embodiments, the second material is a material suitable to resist CIP/SIP treatments and in particular to resist VPHP (Vapor Phase Hydrogen Peroxide) treatments which use hydrogen peroxide vapors.

According to some embodiments, the second material can be chosen in a group consisting of a cobalt-chromium alloy, such as for example stellite, nickel alloy, stainless steel, a material with a polymer matrix, such as for example polyetheretherketone (PEEK), a metal-ceramic composite material, carbon fibers, or other material suitable to be subjected to decontamination and sterilization treatments without suffering damage or oxidation.

The coating 20 performs the function of protecting the first material, which therefore, since it does not itself need to have characteristics of tolerance to intensive treatments, can be chosen from the light materials indicated above, and, as a function of the type of material used, the components 10 can be made with reduced thicknesses.

According to some embodiments, the thermal spray treatment can be chosen between a cold spray treatment, and a high velocity oxygen-fuel (HVOF) coating spray treatment.

According to some embodiments, the method provides to subject both the external surface 18 of the components 10, and also the respective coupling edges thereof, to the cold spray treatment or to the HVOF treatment.

According to some embodiments, the cold spray treatment provides to spray, by means of a spray nozzle 21, a mixture formed by a gas which carries powders or solid particles of the material to be used to form the coating 20, toward the surface to be treated.

According to possible solutions, at least a part of the carrier gas is heated to temperatures comprised between 200° C. and 1200° C.

According to example embodiments, a part of the gas can be heated and conveyed toward the spray nozzle 21 through a first conduit 22, while the remaining part of the carrier gas can be kept at room temperature and is made to pass through a tank, not shown, containing powders of the second material, and conveyed toward the spray nozzle 21, through a second conduit 23.

According to some embodiments, in the spray nozzle 21 the powders in the gas flow are accelerated and projected at supersonic speed, generally comprised between 300 m/s and 1400 m/s, toward the surface to be treated.

According to some embodiments, the pressure of the carrier gas can be comprised between 5 bar and 100 bar as a function of the type of material and the size of the particles that are carried.

According to some embodiments, nitrogen or argon can be used, for example, as carrier gases.

Advantageously, the spray nozzle 21 can have a converging-diverging shape which favors the acceleration of the powders and of the carrier gas.

When the accelerated particles impact the surface to be treated, the impact determines a deformation of the treated surface, generating a stable and permanent coupling between it and the particles of material.

According to some embodiments, with each passage of the spray nozzle 21 on the surface to be treated, a layer of material having a thickness comprised between about 15 μm and about 100 μm can be deposited. According to some embodiments, the method can provide to deposit a plurality of overlapping layers, until the coating 20 with a desired thickness is obtained.

According to some embodiments, the coating 20 can comprise a plurality of overlapping layers made by means of the cold spray treatment, in which the subsequent layers can be made with the same material, or with different materials, as a function of needs.

According to some embodiments, the high velocity oxygen-fuel (HVOF) coating spray treatment provides to heat and accelerate particles of the second material by means of a gas flow obtained by the combustion of oxygen and a fuel in a combustion chamber.

The gas flow obtained from the combustion is accelerated up to a speed even higher than 2,000 m/s. The powders of the second material are injected into the gas flow, which are partly melted and accelerated up to a speed of about 1,000 m/s and finally are ejected through a spray nozzle 21 toward the surface to be coated. When the particles impact the surface, thanks to the high kinetic energy they have, they quickly solidify giving rise to lamellar structures that form a dense coating.

According to some embodiments, also in the case of the HVOF treatment it can be provided to deposit a plurality of overlapping layers, until the coating 20 having a desired thickness is obtained, possibly modifying the type of material of the subsequent layers as a function of needs.

According to some embodiments, the method provides to subject each component 10 to the thermal spray treatment individually, before coupling it with other components 10 to make a piece of equipment 11 or a part thereof, and before installing it inside the chamber 12. In these embodiments, the thermal treatments for depositing a coating on the external surfaces 18 and/or on the coupling edges 17 are carried out outside the chamber 12, in suitable work centers, suitably equipped to carry out the thermal treatments described above.

According to a possible embodiment, the method provides to position the component 10 in a stable manner during the thermal spray treatment step, so as to prevent unwanted movements due to the pressure exerted by the mixture of gas and particles of the second material.

According to some embodiments, the method can provide to position and hold in position the components 10 by means of supports having respectively mating shapes, such as to protect and cover the respective internal surfaces 19 of the components 10 themselves.

The method according to the invention provides to use a spray nozzle 21, for example installed on an anthropomorphic arm, or a CNC (Computer Numerical Control) machine, not shown, having at least four working axes. In particular, according to some embodiments, the method provides to follow on each occasion with the spray nozzle 21 the development of the external surface 18 of the component 10 and possibly of the coupling portions.

Figure 2C:
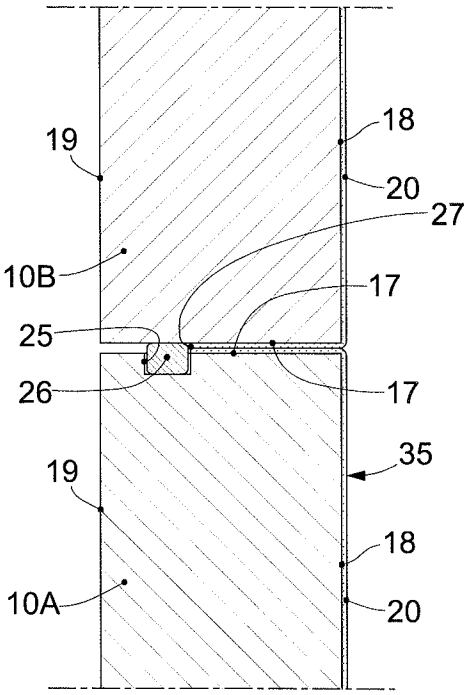
FIGS. 2*a*-2*c* are schematic section views of subsequent steps of a method to manufacture a component according to the embodiments described here.
Figure 2B:
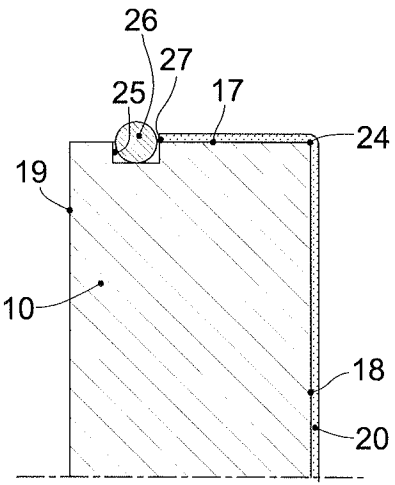
Figure 2A:
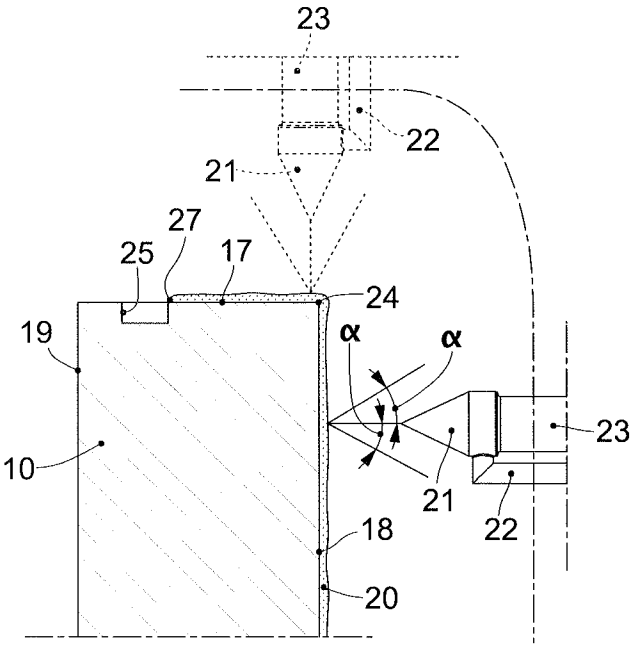

According to some embodiments, for example shown in FIG. 2*a*, the method provides to also follow with the spray nozzle 21 the development of the coupling edges 17 defining respective corners 34, substantially stepped, with the respective external surface 18.

According to possible solutions, the spray nozzle 21 can follow the profile of the surface to be treated on the basis of a path that is predefined and pre-set on the basis of the shape of the element being worked.

According to a variant, the path and orientation of the spray nozzle 21 can be defined in real time, for example by processing images acquired by 3D cameras, which are also installed on the same anthropomorphic arm that supports and moves the spray nozzle 21.

According to possible variants, it can also be provided that the component 10 being worked and the spray nozzle 21 move with relative motion with respect to each other. For example, it can be provided that the element being worked translates in one direction and that the spray nozzle 21 moves on three axes, so that the combination of the respective movements provides the degrees of freedom of an arm that has at least four axes.

According to some embodiments, the method provides to direct the spray nozzle 21 in such a way as to spray the second material with an angle of incidence a comprised between ±45° with respect to the direction orthogonal to the external surface 18 and the coupling portions, or the coupling edges 17 (FIG. 2*a*).

Thanks to this angle of incidence a it is possible to direct the mixture of gas and particles of the second material in a targeted manner, even in correspondence with possible uneven parts of the surface to be treated, and in particular in correspondence with the corners 24 between the external walls 18 and the respective coupling portions and/or coupling edges 17 so as to obtain a coating 20 with a homogeneous thickness.

According to some embodiments, in the event possible accumulations of the second material form in correspondence with the corners 24, or in correspondence with possible hollows or protrusions of the external surface 18, the method according to the invention can provide to remove these accumulations by means of a suitable tool, immediately after the deposit of the coating 20 itself and substantially continuously.

According to some embodiments, the tool can be installed adjacent to the spray nozzle 21, so as to act on the surface just hit by the mixture of gas and particles during the movement of the spray nozzle 21 itself.

According to some embodiments, after making the coating 20 on the external surfaces 18 and the coupling edges 17 of the components 10, the method provides to assemble the components 10 one to the other in a suitable manner, in order to form a piece of equipment 11 (or a device, or an element), or install them in the chamber 12, so that possible respective internal surfaces 19 are protected and isolated from the outside (that is, with respect to the chamber 12) and the respective external surfaces 18 are all facing toward the outside, exposed to the atmosphere of the chamber 12.

According to some embodiments, the method can provide to insert a sealing element 26 between the coupling portions intended to be located reciprocally in contact in order to ensure a sealed closure between two respective components 10A, 10B (FIG. 2*b*), or between a component 10 and a wall 13 of the chamber 12.

According to some embodiments, in the event the component 10 is provided with a housing seating 25 for the sealing element 26 on at least one coupling edge 17 (FIGS. 2*a*-2*c*), the method provides to coat the respective coupling edge 17 from the external corner 24 up to at least one external margin 27 of the housing seating 25.

Embodiments described here also concern a method to prepare a protected chamber 12 for a machine for the production and/or packaging of pharmaceutical products, that is, a method which allows to obtain a chamber 12 subjected to decontamination and sterilization treatments which is ready for use, in which the pharmaceutical products to be subjected to processing and/or packaging can be introduced.

According to some embodiments, the method to prepare the chamber 12 according to the invention provides to make available a plurality of components 10 manufactured, outside the chamber 12, by means of the manufacturing method according to the present invention, each provided with a coating 20 of a material suitable to be subjected to CIP/SIP treatments, the coating extending at least on the external surface 18 of each component 10 intended to be located, in an assembled and installed condition, in the chamber 12, exposed to the atmosphere thereof.

Subsequently, the method provides to assemble the components 10 together to make a piece of equipment 11, such as the pieces of equipment 11 shown in FIG. 1 and described above.

According to some embodiments, the method provides to couple two or more components 10 together, disposing their respective coupling edges 17 facing each other. This operation can preferably be carried out, at least partly, outside the chamber 12 in a step of assembling the pieces of equipment 11, where the components 10 provided with the coating 20 are reciprocally assembled.

According to some embodiments, the method also provides to install the individual components 10 and/or the pieces of equipment 11 inside the chamber 12, possibly taking them inside through the transfer ports 15.

According to possible variants, it can also be provided that the components 10 are coupled with each other to form a piece of equipment 11 directly inside the chamber 12.

Subsequently, once the installation of the components 10 and of the necessary pieces of equipment 11 in the chamber 12 is completed, the method according to the invention provides to close the latter, for example by closing the transfer ports 15, so as to isolate it in a sealed manner from the external environment.

Finally, the method according to the invention provides to subject the chamber 12 and the components 10 and equipment 11 disposed therein to a decontamination or sterilization treatment, for example a CIP/SIP treatment, so as to decontaminate and/or sterilize at least the respective external surfaces 18. By way of a non-limiting example, the decontamination and sterilization treatments provide the use of hydrogen peroxide vapors.

Since all the surfaces that are exposed to the decontamination/sterilization treatment inside the chamber 12 have previously been subjected to the coating treatment, the external surfaces of equipment 11 are not ruined or damaged by the decontaminants used. The decontamination treatments can therefore be repeated, when necessary, without needing to remove or cover the components 10 and equipment 11 inside the machine, thus allowing significant savings in time and manpower required.

It is clear that modifications and/or additions of parts may be made to the method to manufacture a component 10, to the component 10 and to the method to prepare a chamber 12 as described heretofore, without departing from the field and scope of the present invention.

It is also clear that, although the present invention has been described with reference to some specific examples, a person of skill in the art shall certainly be able to achieve many other equivalent forms of method to manufacture a component 10, component 10 and method to prepare a chamber 12, having the characteristics as set forth in the claims and hence all coming within the field of protection defined thereby.

The invention claimed is:

1. A method to manufacture a component suitable to be installed inside a protected chamber of a machine for a production and/or packaging of pharmaceutical products, wherein said chamber is a controlled atmosphere chamber, separated from an external environment in a sealed manner, and configured to receive said component, wherein the interior of said chamber and said component are intended to be subjected to decontamination and sterilization treatments, the method comprising:

making available said component having at least one external surface and made of a first non-steel material chosen from a group comprising aluminum, magnesium, titanium, or their alloys, composite materials with a polymer matrix, carbon fibers, or combinations thereof, wherein said component is intended to be installed inside said chamber, and is provided with at least one coupling portion configured to be coupled with a corresponding and mating coupling portion provided on another component or on an internal wall of the chamber, wherein said at least one external surface, when the component in an assembled and installed condition is directly exposed to the atmosphere of the chamber;

before assembling or installing the component in said chamber, that is, before the coupling portion is stably joined to said corresponding and mating coupling portion or to said internal walls of the chamber, subjecting said at least one external surface to a thermal spray treatment using solid powders of a second material, accelerated in a supersonic gaseous jet, wherein said second material is chosen from a group comprising one or more of stainless steel, cobalt-chromium metal alloy, nickel alloy, a material with a polymer matrix, and a metal-ceramic composite material, in order to deposit a coating of said second material on said at least one external surface to make the component suitable to withstand said decontamination or sterilization treatments.

2. The method as in claim 1, wherein said thermal spray treatment is chosen from:

a cold spray treatment in which the solid powders of said second material are accelerated in a supersonic gaseous jet; and a spray treatment with high velocity oxygen-fuel (HVOF) coating, in which particles of said second material, at least partly melted, are accelerated in a jet of supersonic gas, having high speed and temperature, obtained from combustion of oxygen and a fuel.

3. The method as in claim 2, wherein said cold spraying provides to spray on said external surface a mixture of a gas which transports solid particles of said second material with a speed comprised between 300 m/s and 1400 m/s, and to hold said component on each occasion in a fixed and stable position, by means of supports suitable to resist the force exerted by said mixture of gas that transports said solid particles.

4. The method as in claim 3, further comprising heating at least a part of said mixture of gas that transports said solid particles to temperatures of about 200-1100° C.

5. The method as in claim 3, wherein said mixture of gas that transports said solid particles has a pressure comprised between 5 bar and 100 bar.

6. The method as in claim 5, wherein a housing seating is provided on said coupling portion, said housing seating being configured to house a sealing element, and said method further comprises coating at least one external surface of said coupling portion near an external margin of said housing seating.

7. The method as in claim 1, further comprising using a spray nozzle installed on an anthropomorphic arm and/or on a numerical control machine having at least four working axes, and following with said spray nozzle a profile of the external surface of said component.

8. The method as in claim 7, further comprising positioning said spray nozzle in such a way as to spray said second material with an angle of incidence comprised between ±45° with respect to a direction orthogonal to the external surface to be coated.

9. The method as in claim 7, wherein, in an event that accumulations of said second material are formed in correspondence with corners defined between said external surface and coupling edges, or in correspondence with possible hollows or protrusions of said external surface, said method provides to remove said accumulations by means of a suitable tool, immediately after said second material has been deposited, substantially continuously during movement of said spray nozzle.

10. A method to prepare a chamber of a machine for the production and/or packaging of pharmaceutical products, wherein said chamber is a protected chamber, with a controlled atmosphere, isolated and separated from the external environment in a sealed manner, and configured to receive a component suitable to be installed inside said chamber; the method comprising:

making a plurality of components using the manufacturing method as in claim 1;

assembling or installing said components in their respective positions inside said chamber in correspondence with respective coupling portions configured to be coupled with corresponding and mating coupling portions provided on another component or on an internal wall of said chamber, in order to make said components able to work said products;

disposing said at least other components in pre-established positions inside said chamber;

closing said chamber in such a way as to isolate it in a sealed manner from the external environment; and subjecting the interior of said chamber to a decontamination or sterilization treatment, in such a way as to decontaminate and/or sterilize at least the respective external surfaces of said components previously disposed in said chamber.

11. The method as in claim 10, wherein said decontamination or sterilization treatments use hydrogen peroxide vapors (VPHP, Vapor Phase Hydrogen Peroxide).

* * * * *